US005098523A

United States Patent [19]

Ilmarinen et al.

[11] Patent Number: 5,098,523

[45] Date of Patent: Mar. 24, 1992

[54] PRESS ROLL WITH WEDGE CLAMP FOR THE PRESS JACKET EDGES

[75] Inventors: Antti I. Ilmarinen, Jyväskylä, Finland; Nils-Erik R. Karlsson; Nils-Erik Safman, both of Karlstad, Sweden; Carl Zetterman, Hammarö, Sweden

[73] Assignee: Valmet Paper Machinery, Inc., Helsingfors, Finland

[21] Appl. No.: 638,794

[22] Filed: Jan. 8, 1991

[30] Foreign Application Priority Data

Jan. 16, 1990 [SE] Sweden ..... 9000147
May 7, 1990 [SE] Sweden ..... 9001617

[51] Int. Cl.[5] ..... D21F 3/08

[52] U.S. Cl. ..... 162/358; 29/117; 162/272; 162/361; 100/153

[58] Field of Search ..... 162/358, 361, 205, 272; 100/118, 153; 29/116.2, 117

[56] References Cited

U.S. PATENT DOCUMENTS

| | | | |
|---|---|---|---|
| 4,044,669 | 8/1977 | Luther | 29/117 |
| 4,563,245 | 1/1986 | Wanke et al. | 162/358 |
| 4,584,059 | 4/1986 | Schiel et al. | 162/361 |
| 4,625,376 | 12/1986 | Schiel | 29/119 |
| 4,707,222 | 11/1987 | Müllner et al. | 162/205 |
| 4,861,434 | 8/1989 | Bonander et al. | 162/358 |
| 5,011,578 | 4/1991 | Lange | 162/358 |

FOREIGN PATENT DOCUMENTS

| | | |
|---|---|---|
| 3338487 | 6/1985 | Fed. Rep. of Germany . |
| 3607941 | 10/1988 | Fed. Rep. of Germany . |
| 3805350 | 8/1989 | Fed. Rep. of Germany . |
| 2272838 | 1/1975 | France . |

*Primary Examiner*—Karen M. Hastings
*Attorney, Agent, or Firm*—Bell, Seltzer, Park & Gibson

[57] ABSTRACT

The press roll cooperates with a counter roll to form a press with a long nip for paper or board machines. The press roll has two end walls; a flexible jacket secured to the end walls; and support members for the end walls. The end walls have bearings for permitting rotation of the jacket and the end walls in relation to the support members; and a press shoe intended together with the counter roll to form a pressing zone. Attachment assemblies each have a circular clamping member, which includes a wedge body, and a circular groove disposed on the inside of the end wall to receive the edge portions of the jacket and the wedge body, the groove and wedge body being provided with cooperating wedge forming surfaces. Further, the clamping member includes bolts for pulling the wedge body into the groove and retaining it therein in order to clamp the edge portions of the jacket by means of wedge action, against the end wall.

14 Claims, 2 Drawing Sheets

PRESS ROLL WITH WEDGE CLAMP FOR THE PRESS JACKET EDGES

FIELD AND BACKGROUND OF THE INVENTION

The present invention relates to a press roll intended to cooperate with a counter roll to form a press with a long nip for paper or board machines.

Presses with a long nip for paper or board machines are known for instance through U.S. Pat. No. 4,563,245, U.S. Pat. No. 4,584,059, U.S. Pat. No. 4,625,376, U.S. Pat. No. 4,707,222, DE 3 607 941 and DE 3 805 350. The press roll of such presses comprises two end walls, a tubular, flexible, liquid-impervious jacket secured at its edge portions by means of an attachment means to peripheral portions of the end walls; stationary support members for supporting the end walls, said end walls comprising bearing means for permitting rotation of the jacket and the end walls in relation to the stationary support members about an axis of rotation; and a press shoe intended together with the counter roll to form a pressing zone with said long nip, the jacket upon rotation being moved through the pressing zone in sliding contact with the press shoe. Within the pressing zone in said known presses, the jacket is forced inward by means of the counter roll to said sliding contact with the press shoe. The part of the jacket pressed against the press shoe will then lie in an axial line located radially inside a line extending between the peripheral end wall portions forming the attachment locations for the edge portions of the jacket, the radial distance between these lines being between 20 and 40 mm. High local axial strains occur in the jacket due to this pressing, when the jacket passes through the pressing zone. These local strains consequently cease immediately after the jacket has left the pressing zone. The strain thus occurring repeatedly in the jacket causes not only fatigue in the material, but also causes considerable tensions at the attachment locations on the end walls and on the end wall bearings. The service life of the jacket becomes too short and both jacket and end wall bearings must be replaced regularly with consequential stoppages and loss of production. To secure the jacket to the end walls attachment means are used which include holes and/or recesses in the jacket itself for inserting bolts which by means of a clamping ring clamp the jacket against the end wall. Local strains occur at the holes and recesses which may cause the jacket to be damaged and the tension will be uneven around the circumference. Furthermore, the jacket may come loose at one or more points because the clamping ring and bolts provide insufficient clamping force to retain the jacket in the desired taut state. The use of holes and recesses in the edge portions of the jacket results in increased costs for manufacturing the jacket in accordance with carefully specified dimensions for each axial size of press roll.

DE Al 3 338 487 describes special connection means disposed at the edges of the jacket and the peripheral end wall portions so that the edge portions of the jacket are axially movable in relation to the end walls. The connection means include engagement means formed directly at the edge portions of the jacket, or separate axially movable engagement elements which can bend or roll and which connect the edge portions of the jacket to the end walls via a fixed securing member, or flexible sealing elements which connect the edge portion of the jacket to the end walls via an axially movable securing member, or a combination of the two first mentioned embodiments. The use of engagement means formed in the edge portions of the jacket results in increased costs for manufacturing the jacket in accordance with carefully specified dimensions for every axial size of press roll. The use of axially movable engagement elements, which can bend or roll, results in the risk of the edge portions of the jacket being pulled out of its engagement position after repeated axial movements of the edge portions to and fro. Furthermore, all embodiments of connection means are relatively complicated to manufacture and fit.

SUMMARY OF THE INVENTION

The object of the present invention is to provide a press roll with improved attachment means which secure the jacket to the end walls with sufficient force, said force also being distributed uniformly around the circumference of each edge portion of the end wall, and said securing being intact and effected without holes or the like having to be made in the flexible jacket. The jacket can consequently be manufactured and mounted in a considerably simpler manner than known jackets.

The present invention relates to a press roll intended to cooperate with a counter roll to form a press with a long nip for paper or board machines, said press roll comprising two end walls, a tubular, flexible, liquid-impervious jacket secured at its edge portions by means of an attachment means to peripheral portions of the end walls; stationary support members for supporting the end walls, said end walls having bearing means permitting rotation of the jacket and the end walls in relation to the stationary support members about an axis of rotation; and a press shoe forming with the counter roll a pressing zone with said long nip, said jacket upon rotation being moved through the pressing zone in sliding contact with the press shoe, said attachment means for securing an edge portion of the jacket to the end wall comprising a circular clamping member including a wedge body, and a circular groove disposed on the inside of said end wall to receive the edge portion of said jacket and wedge body, said groove and wedge body being provided with cooperating wedge-forming surfaces, and said clamping member including means for forcing said wedge body into the groove and retaining it therein in order to clamp said edge portion of the jacket by means of wedge action, against said end wall.

The invention is described hereinafter in more detail with reference to the accompanying drawings.

DESCRIPTION OF PREFERRED EMBODIMENTS

Figure 1:
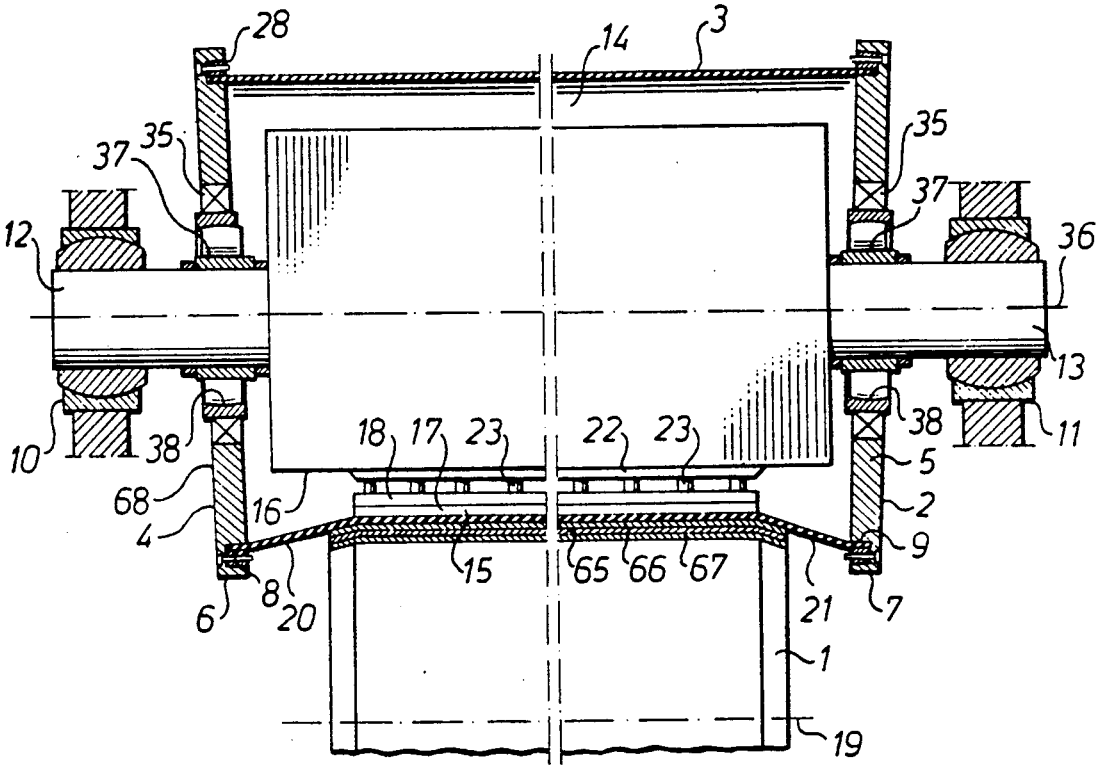
FIG. 1 is a partially schematic view, primarily in vertical section, of a press roll and adjacent component of a wet press, the press roll having attachment means according to a first embodiment of the invention to secure a jacket to the press roll end walls.

Referring to FIG. 1, this shows schematically parts of a wet press disposed in the wet section of a paper machine or a board machine in order to press water out of and consolidate a formed wet fibrous web 65.

The wet press comprises a rotatable counter roll 1 and a press roll 2, which has a tubular reinforced jacket 3 impervious to liquid, and two opposite circular end walls 4, 5, the edge portions 8 and 9 of the jacket being connected in an air and liquid tight manner to the peripheral portions 6 and 7, respectively, of the end walls 4, 5 as will be described below. The jacket is flexible and dimensionally stable. The press roll is mounted in two stand parts 10, 11 by means of support members in the form of two stationary support pins 12, 13 of circular cross section. The support pins extend in an air-tight and liquid-tight manner through central openings in the end walls 4, 5. The end walls 4, 5, jacket 3 and support pins 12, 13 thus define an air-tight and liquid-tight chamber 14 which can be placed under sufficient pressure, e.g. 0.1 bar overpressure, to displace the end walls 4, 5 apart from each other in order to keep the jacket 3 sufficiently stretched. The end walls 4, 5 are consequently axially displaceable in relation to the support pins 12, 13. Alternatively, spring means (not shown), may be disposed in the press roll to press against the end walls or one of them in order to stretch the jacket in the axial direction. Pneumatic or hydraulic cylinders may also be utilized for this purpose, or any suitable combination of the three arrangements mentioned.

The press roll 2 also includes a press shoe 15 that is disposed opposite the counter roll 1 and which, together with it, forms a pressing zone having a long nip within a predetermined sector of the counter roll 1, where the jacket 3 is thus pressed down against the press shoe and wraps the predetermined sector of the counter roll 1. The press shoe 15 is supported by an inner stand 16, illustratively in the form of a beam secured to axially inner portions of the support pins 12, 13. Support means of suitable form, such as axial laths or strips (not shown) may be disposed on the inside of the jacket to provide support for the jacket when it is being mounted. Such support means may be attached to the inner stand 16 via suitable bracings (not shown).

The fibrous web to be dewatered is enclosed between two felts 66, 67, each disposed to run in a loop over a plurality of rolls (not shown) and through said pressing zone. During operation, the continuous wet fibrous web 65 runs through the pressing zone together with the felts 66, 67, which absorb the liquid pressed out of the fibrous web. If desired, the felt 67 adjacent the counter roll 1 may be omitted so that a single-felt press is obtained.

Any suitable press shoe may be used. The shoe 15 shown consists of a sliding part 17 and a frame part 18, the sliding part 17 having a slide surface along which the jacket 3 moves in sliding contact. The shoe 15 located opposite the counter roll 1 extends transversely across the jacket 3, parallel with the axis of rotation 19 of the counter roll 1 and it is the same length or slightly shorter than the length of the counter roll 1. This in turn is shorter than the press roll 2 so that inclined, indented sections 20, 21 are formed in those section of the jacket 3 located axially outside of the counter roll, within the area for the pressing zone. In the preferred embodiment shown the press shoe 15 is connected to the stand 16 via a jack unit 22 having several jacks 23 by means of which the pressure of the press shoe 15 on the jacket 3 and the fibrous web can be controlled. A channel system (not shown) is also disposed in the press shoe 15 for the supply of lubricant to the sliding surface of the sliding part 17, thus producing and maintaining a friction-reducing film between the jacket 3 and press shoe 15. The press shoe 15 can be provided with hydrostatic pressure pockets (not shown) filled with pressure liquid acting on the inner side of the jacket 3 to compress the fibrous web in a controlled manner.

Circular bearing means 35 associated with end walls 4, 5 permit rotation of the jacket 3, and a section 68 of each end wall located radially outside the bearing means 35 about an axis of rotation 36 which need not necessarily coincide with the central axis of the support pins 12, 13. In the embodiment shown in FIG. 1 each of the bearing means 35 consists of rolling bearings, such as ball or roller bearings. Alternatively sliding bearings with flat or spherical sliding surfaces may be used. Further, end walls 4, 5 have associated cylindrical sliding bearings 37 that allow axial displacement of the end wall 4, 5 in relation to the support pins 12, 13. Alternatively, only one of the end walls may be provided with such a sliding bearing 37 to effect axial displacement of the end wall 4 or 5. The end walls 4, 5 may include surrounding means 38 concentric with the axis of rotation 36 of the jacket and permitting free axial movement of the peripheral end wall portions 6, 7 relative to each other and to the press shoe 15, or the nip region, in response to the action of axial strains which occur in the jacket 3 upon its passage through the pressing zone. Of course, the invention is also applicable to press rolls not provided with such means 38.

The edge portions 8, 9 of the jacket 3 are rigidly connected by attachment means to the peripheral portions 6, 7 of the end walls to give a sufficiently strong and tight joint. The peripheral end wall portions 6, 7 are substantially rigid and are made of a suitable metal material. The same reference numerals are utilized in the following to indicate parts and elements which are similar or substantially similar in the different embodiments. According to the invention each attachment means includes a circular groove 24 disposed on the inside of each peripheral end wall portion 6, 7 and having two opposite side walls 25, 26 forming a small angle to each other so that the width of the groove 24, i.e. its radial dimension, decreases in the direction towards the bottom 27 of the groove. Said angle is typically about 5°. One of the end walls, viz. wall 26 receives the jacket 3 and preferably extends axially (i.e., generally parallel to axis 36). The attachment means includes a circular clamping member 32 having a wedge body 28 the shape of which corresponds to the shape of the groove 24 so that the wedge body and the groove have cooperating wedge-forming surfaces 25, 33 and 26, 34, that respectively clamp the edge portions 8, 9 of the jacket by wedge action. The opposite wedge forming surfaces 33, 34 of the wedge body 28 thus define a small angle with each other corresponding to said angle defined by the side walls 25, 26 of the groove 24. The clamping member 32 is provided with a plurality of axial tapped holes 30 that are aligned with axial holes 31 in the end wall. Bolts 29 inserted into holes 30, 31 from the outer side of the end wall are in threaded engagement with the holes 30 of the clamping member. By means of the bolts 29 the wedge body 28 is forced into the groove 24 so that the edge portion 8, 9 of the jacket are clamped by increasing wedge force between the wedge body 28 and the side wall 26 of the groove. It is understood that the wedge body 28 and the groove 24 are dimensioned with respect to each other so that the wedge body does not contact the bottom 27 of the groove.

Figure 2:
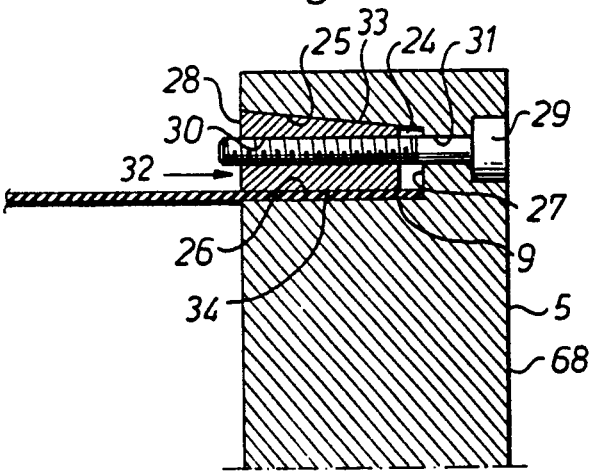
FIG. 2 is an enlarged fragmentary sectional view of one of the attachment means according to FIG. 1, in which a groove of the attachment means is formed in the adjacent end wall of the press roll.

In the embodiment of the attachment means illustrated in FIGS. 1 and 2 the groove 24 formed by a recess in the adjacent end wall 5, 6 is at a slight distance from the outer circumferential surface of the end wall. From a practical point of view, the wedge body 28 has to be disposed on the outer side of the jacket. The radially inner side wall 26 of the groove 24 thus is axially aligned in order to receive the adjacent edge portion 8, 9 of the jacket. The wedge body 28 is divided into a plurality of circular identical arc-shaped segments, e.g. 3 to 6 segments, which are provided with the axial holes 30 for the bolts 29.

Figure 3:
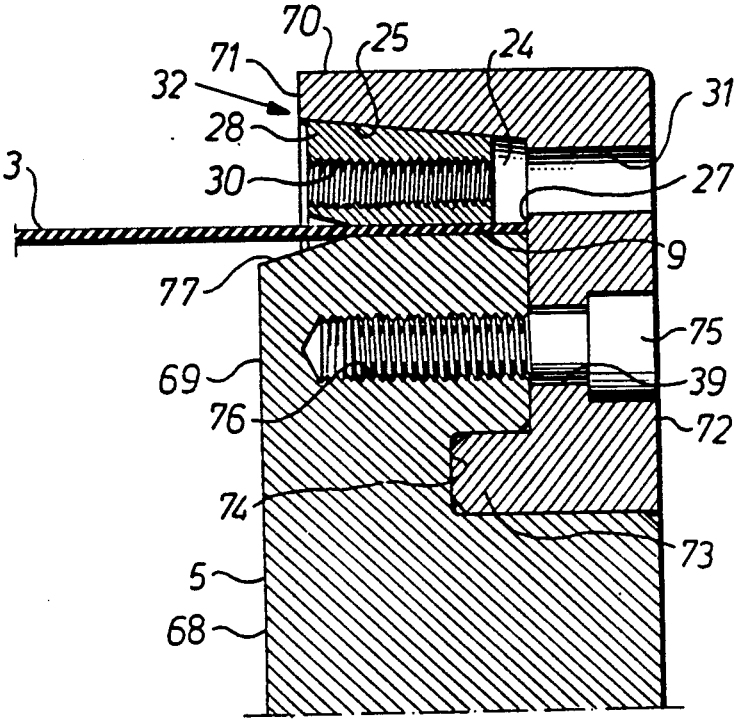
FIG. 3 is an enlarged fragmentary sectional view of an attachment means according to a second embodiment wherein the groove is surrounded by an outer ring of the end wall.
Figure 4:
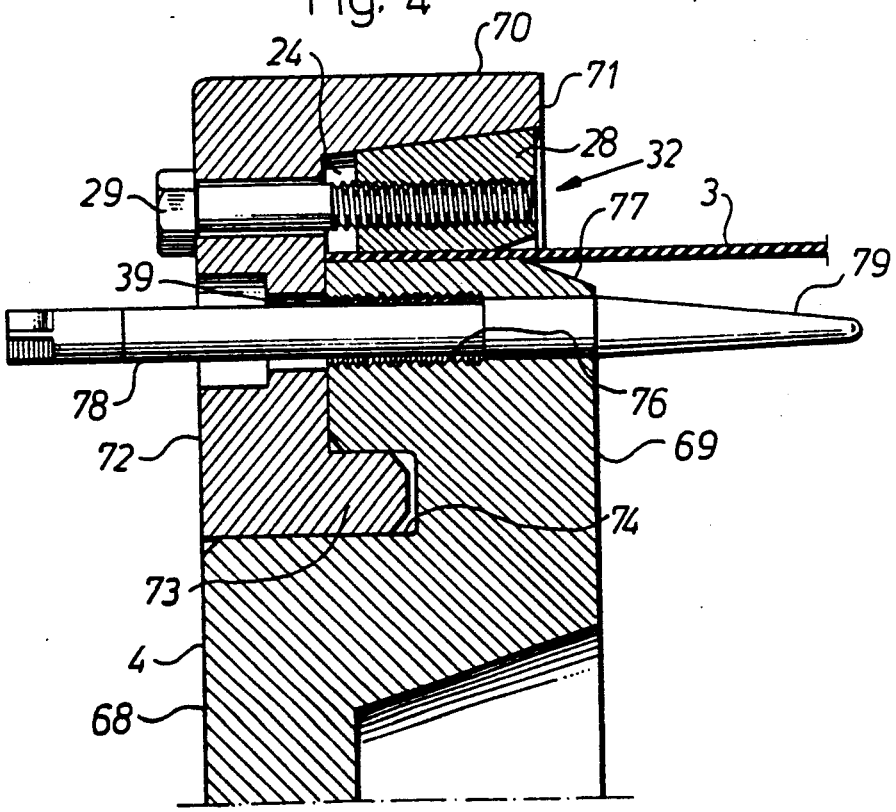
FIG. 4 is an enlarged fragmentary sectional view of an attachment means according to FIG. 3 associated with the other end wall and of the press roll and having an aid for mounting the jacket to the end wall.

In the embodiments of the attachment means illustrated in FIGS. 3 and 4 the groove 24 is located between and bordered by the outer circumferential surface of the end wall and a separate outer ring 70 which surrounds the end wall 4, 5. The outer ring 70 has a substantially L-shaped cross-section with an axially extending shank 71 and a radially inwardly extending shank 72. The shank 72 has an axially protruding projection 73 which is arranged to be received in a circular recess 74, corresponding to the projection 73, on the outer side of the end wall 4, 5 in order to fix the position of the outer ring 70 radially to the end wall. The outer ring 70 is screwed to the end wall by means of a plurality of axial bolts 75 extending through axial holes 39 in the shank 72 and screwed into tapped axial holes 76 in the end wall 4, 5. The groove 24 is thus defined by the axial shank 71 and the adjacent end wall 4, 5. Most of the inner side wall 26 is parallel to the axis of rotation 36 of the jacket 3. However, a small part of the side wall 26 is bevelled to form a conical guide surface 77 disposed to facilitate insertion of the edge portions 8, 9 of the jacket 3 into the groove 24 when the jacket is being mounted. To facilitate assembly of the outer ring 70 it is suitably divided into a plurality of circular identical arc-segments, e.g. six segments. To facilitate assembly of a jacket 3 on the end walls 4, 5 an aid may be used of the type and in the manner illustrated in FIG. 4. The aid consists of a plurality of guide pins 78 which temporarily replace a specific number, e.g. every two, of the bolts 75 normally retaining the outer ring 70 to the end wall 4, 5. The holes selected for the guide pins 78 are drilled through so that a conically tapering guide portion 79 of each guide pin 78 will be located on the inside of the end wall 4, 5. The conical guide surface 77 of the groove 24 cooperates with the conical guide portions 79 of the guide pins 78 so that the edge portion 8, 9 of the jacket can be guided over from the conical guide portions 79 to the guide surface 77 and then into the groove 24 to its bottom 27 or the vicinity thereof. The segments forming the wedge body 28 are then mounted by the bolts 29 so that the jacket is firmly wedged as described above.

Before the bolts 29 are fully tightened it is advisable to place the chamber 14 under a low overpressure by blowing in air. The jacket 3 will then endeavour to assume a uniform shape circumferentially, and should any unevenness exist, differences will appear in the axial strains at the edge portions 8, 9 of the jacket. Since axial movement of the edge portions is now permitted those circumferential sections of the edge portions where the strains are greatest will be pulled out until uniformity has been achieved. Thereafter the bolts 29 are finally tightened to achieve the desired strong wedge joint.

That which is claimed is:

1. A press roll for a wet press having a counter roll to form a press with a long nip for paper or board machines, said press roll comprising two end walls each having an inner surface and an outer surface, a tubular, flexible, liquid-impervious jacket secured at its edge portions by means of an attachment means to peripheral portions of the end walls; stationary support members for supporting the end walls, said end walls including bearing means for permitting rotation of the jacket and the end walls in relation to the stationary support members about an axis of rotation; and a press shoe forming with the counter roll a pressing zone having said long nip, said jacket upon rotation being moved through the pressing zone in sliding contact with the press shoe, said attachment means for securing an edge portion of the jacket to the end wall comprising a circular clamping member including a wedge body, and a circular groove that is spaced radially inwardly from an outer circumferential surface of said end wall or that is bordered by the outer circumferential surface of the end wall and by an outer ring which is secured to said end wall, said groove opening from the inner surface of said end wall to receive the edge portion of said jacket and wedge body, said groove and wedge body being provided with cooperating wedge-forming surfaces, and said clamping member including means for forcing said wedge body into the groove and retaining it therein in order to clamp said edge portion of the jacket within said groove by means of wedge action, against said end wall.

2. A press roll as recited in claim 1 wherein said circular groove converges inwardly towards its bottom, and the side wall of the groove contacted by the jacket is substantially parallel with the axis of rotation of the jacket.

3. A press roll as recited in claim 1 wherein said circular groove is bordered by the outer circumferential surface of the end wall and by the outer ring, and wherein outer ring is secured to the end wall by means of a plurality of bolts.

4. A press roll as recited in claim 1 wherein said clamping member is located radially outwardly of the jacket.

5. A press roll as recited in claim 3 wherein said outer ring has a substantially L-shaped cross-section and includes an axially extending shank surrounding said groove and a radially extending shank provided with holes for said bolts for attaching the outer ring onto the end wall.

6. A press roll as recited in claim 5 wherein said holes in said radial shank are parallel to said axis of rotation and are axially aligned with axial tapped holes in said end wall for screwing said bolts therein.

7. A press roll as recited in claim 6 wherein said radial shank has an axially extending projection, and said end wall has a recess corresponding to said projection to receive the projection to fix the position of said outer ring radially in relation to the end wall.

8. A press roll as recited in claim 3 wherein said outer ring is formed by a plurality of circular arcsegments.

9. A press roll as recited in claim 5 wherein a plurality of guide pins are provided to assist in inserting said jacket into the groove, said pins being inserted in through-holes in said end wall and each having a free guiding portion located on the inside of the end wall, radially inside and in the vicinity of said groove so that said edge portion of the jacket can be guided into said groove from said free guide portions.

10. A press roll as recited in claim 9 wherein said guiding portion is conical in shape and arranged to cooperate with a conical guide surface of said groove to allow sliding transfer of said edge portion of the jacket.

11. A press roll as recited in claim 3 wherein said clamping member is provided with axial tapped holes disposed to be aligned with axial through-holes in said end wall, and said means for forcing said wedge body into said groove and retaining it therein include a corresponding number of bolts for screwing into said clamping member.

12. A press roll as recited in claim 11 wherein said holes in the clamping member for receiving said bolts are disposed in said wedge body of the clamping member.

13. A press roll as recited in claim 4 wherein said wedge body is formed by a plurality of identical circular arc-shaped segments.

14. A press roll as recited in claim 13 wherein said clamping member is provided with axial tapped holes disposed to be aligned with axial through-holes in said outer ring, and said means for forcing said wedge body into said groove and retaining it therein include a corresponding number of bolts for screwing into said clamping member.

* * * * *